US005658863A

United States Patent [19]

Duncan et al.

[11] Patent Number: 5,658,863

[45] Date of Patent: Aug. 19, 1997

[54] BIODEGRADABLE BRANCHED SYNTHETIC ESTER BASE STOCKS AND LUBRICANTS FORMED THEREFROM

[75] Inventors: Carolyn Boggus Duncan; Leah Katherine Meade, both of Baton Rouge, La.

[73] Assignee: Exxon Chemical Patents Inc., Wilmington, Del.

[21] Appl. No.: 572,131

[22] Filed: Dec. 8, 1995

Related U.S. Application Data

[63] Continuation-in-part of Ser. No. 351,990, Dec. 8, 1994, abandoned.

[51] Int. Cl.[6] ..... C10M 129/70; C10M 129/74

[52] U.S. Cl. ..... 508/485; 508/501

[58] Field of Search ..... 508/485, 501

[56] References Cited

U.S. PATENT DOCUMENTS

| | | |
|---|---|---|
| 3,360,465 | 12/1967 | Warman . |
| 4,263,159 | 4/1981 | Berens et al. . |
| 4,382,002 | 5/1983 | Walker et al. . |
| 4,392,967 | 7/1983 | Alexander . |
| 4,440,657 | 4/1984 | Metro et al. . |
| 4,783,274 | 11/1988 | Jokinen et al. . |
| 4,826,633 | 5/1989 | Carr et al. . |
| 5,057,247 | 10/1991 | Schmid et al. . |
| 5,156,759 | 10/1992 | Culpon, Jr. . |
| 5,308,524 | 5/1994 | Miyaji et al. . |
| 5,330,667 | 7/1994 | Tiffany, III et al. . |

FOREIGN PATENT DOCUMENTS

| | | | |
|---|---|---|---|
| 0 406 479 | 1/1991 | European Pat. Off. | C10M 105/38 |
| 0 435 253 | 7/1991 | European Pat. Off. | C10M 105/36 |
| 0 498 152 | 8/1992 | European Pat. Off. | C10M 171/00 |
| A-523560 | 1/1993 | European Pat. Off. . | |
| A-536814 | 4/1993 | European Pat. Off. . | |
| A-430657 | 6/1993 | European Pat. Off. . | |
| A-572273 | 12/1993 | European Pat. Off. . | |
| 0 612 832 | 12/1993 | European Pat. Off. | C10M 105/40 |
| 4-120195 | 4/1992 | Japan | C10M 169/04 |
| 1441918 | 7/1976 | United Kingdom . | |
| 93/11210 | 6/1993 | WIPO | C10M 171/00 |
| 9311210 | 6/1993 | WIPO . | |
| WO-A-9413709 | 6/1994 | WIPO . | |

OTHER PUBLICATIONS

Waal and Kenbeek, "Testing, Application, and Future Development of Environmentally Friendly, Ester Base Fluids", Journal of Synthetic Lubrication, vol. 10, No. 1, Apr. 1993, pp. 67–83.

*Primary Examiner*—Prince Willis, Jr.
*Assistant Examiner*—Cephia D. Toomer
*Attorney, Agent, or Firm*—Richard D. Jordan

[57] ABSTRACT

A biodegradable lubricant which is prepared from: about 60–99% by weight of at least one biodegradable synthetic ester base stock which comprises the reaction product of: a branched or linear alcohol having the general formula $R(OH)_n$, wherein R is an aliphatic or cyclo-aliphatic group having from about 2 to 20 carbon atoms and n is at least 2; and mixed acids comprising about 30 to 80 molar % of a linear acid having a carbon number in the range between about $C_5$ to $C_{12}$, and about 20 to 70 molar % of at least one branched acid having a carbon number in the range between about $C_5$ to $C_{10}$ and wherein no more than 10% of the branched acids used to form the biodegradable synthetic ester base stock contains a quaternary carbon; wherein the ester base stock has an oxygen to carbon ratio of between about 0.15:1 to 0.3:1 and exhibits the following properties: at least 60% biodegradation in 28 days as measured by the Modified Sturm test; a pour point of less than −25° C.; a viscosity of less than 7500 cps at −25° C.; and oxidative stability of up to 45 minutes as measured by HPDSC.

11 Claims, No Drawings

BIODEGRADABLE BRANCHED SYNTHETIC ESTER BASE STOCKS AND LUBRICANTS FORMED THEREFROM

This application is a continuation-in-part of Ser. No. 08/351,990, filed on Dec. 8, 1994, now abandoned.

The present invention relates generally to the use of branched synthetic esters to improve the cold-flow properties and dispersant solubility of biodegradable lubricant base stocks without loss of biodegradation or lubrication. At least 60% biodegradation (as measured by the Modified Sturm test) can be achieved with branching along the chains of the acyl and/or alcohol portions of the ester. These branched synthetic esters are particularly useful in the formation of biodegradable lubricants in two-cycle engine oils. Because of this ester's high carbon to oxygen ratio, the ester burns cleaner, producing less smoke than conventional two-cycle, air-cooled engine lubricant base stocks.

BACKGROUND OF THE INVENTION

The interest in developing biodegradable lubricants for use in applications which result in the dispersion of such lubricants into waterways, such as rivers, oceans and lakes, has generated substantial interest by both the environmental community and lubricant manufacturers. The synthesis of a lubricant which maintains its cold-flow properties and additive solubility without loss of biodegradation or lubrication would be highly desirable.

Base stocks for biodegradable lubricant applications (e.g., two-cycle engine oils, catapult oils, hydraulic fluids, drilling fluids, water turbine oils, greases and compressor oils) should typically meet five criteria: (1) solubility with dispersants and other additives such as polyamides; (2) good cold flow properties (such as, less than −40° C. pour point; less than 7500 cps at −25° C.); (3) sufficient biodegradability to off-set the low biodegradability of any dispersants and/or other additives to the formulated lubricant; (4) good lubricity without the aid of wear additives; and (5) high flash point (greater than 260° C., flash and fire points by COC (Cleveland Open Cup) as measured by ASTM test number D-92).

The Organization for Economic Cooperation and Development (OECD) issued draft test guidelines for degradation and accumulation testing in December 1979. The Expert Group recommended that the following tests should be used to determine the "ready biodegradability" of organic chemicals: Modified OECD Screening Test, Modified MITI Test (I), Closed Bottle Test, Modified Sturm Test and the Modified AFNOR Test. The Group also recommended that the following "pass levels" of biodegradation, obtained within 28 days, may be regarded as good evidence of "ready biodegradability": (Dissolved Organic Carbon (DOC)) 70%; (Biological Oxygen Demand (BOD)) 60%; (Total Organic carbon (TOC)) 60%; ($CO_2$) 60%; and (DOC) 70%, respectively, for the tests listed above. Therefore, the "pass level" of biodegradation, obtained within 28 days, using the Modified Sturm Test is at least ($CO_2$) 60%.

Since the main purpose in setting the test duration at 28 days was to allow sufficient time for adaptation of the micro-organisms to the chemical (lag phase), this should not allow compounds which degrade slowly, after a relatively short adaptation period, to pass the test. A check on the rate of biodegradation therefore should be made. The "pass level" of biodegradation (60%) must be reached within 10 days of the start of biodegradation. Biodegradation is considered to have begun when 10% of the theoretical $CO_2$ has evolved. That is, a readily biodegradable fluid should have at least a 60% yield of $CO_2$ within 28 days, and this level must be reached within 10 days of biodegradation exceeding 10%. This is known as the "10-Day Window."

The OECD guideline for testing the "ready biodegradability" of chemicals under the Modified Sturm test (OECD 301B, adopted May 12, 1981, and which is incorporated herein by reference) involves the measurement of the amount of $CO_2$ produced by the test compound which is measured and expressed as a percent of the theoretical $CO_2$ ($TCO_2$) it should have produced calculated from the carbon content of the test compound. Biodegradability is therefore expressed as a percentage of $TCO_2$. The Modified Sturm test is run by spiking a chemically defined liquid medium, essentially free of other organic carbon sources, with the test material and inoculated with sewage micro-organisms. The $CO_2$ released is trapped as $BaCO_3$. After reference to suitable blank controls, the total amount of $CO_2$ produced by the test compound is determined for the test period and calculated as the percentage of total $CO_2$ that the test material could have theoretically produced based on carbon composition. See G. van der Waal and D. Kenbeek, "Testing, Application, and Future Development of Environmentally Friendly Ester Based Fluids", *Journal of Synthetic Lubrication,* Vol. 10, Issue No. 1, April 1993, pp. 67–83, which is incorporated herein by reference.

One base stock in current use today is rapeseed oil (i.e., a triglyceride of fatty acids, e.g., 7% saturated $C_{12}$ to $C_{18}$ acids, 50% oleic acid, 36% linoleic acid and 7% linolenic acid, having the following properties: a viscosity at 40° C. of 47.8 cSt, a pour point of0° C., a flash point of 162° C. and a biodegradability of 85% by the Modified Sturm test. Although it has very good biodegradability, its use in biodegradable lubricant applications is limited due to its poor low temperature properties and poor stability.

Unless they are sufficiently low in molecular weight, esters synthesized from both linear acids and linear alcohols tend to have poor low temperature properties. Even when synthesized from linear acids and highly branched alcohols, such as polyol esters of linear acids, high viscosity esters with good low temperature properties can be difficult to achieve. In addition, pentaerythritol esters of linear acids exhibit poor solubility with dispersants such as polyamides, and trimethylolpropane esters of low molecular weight (i.e., having a carbon number less than 14) linear acids do not provide sufficient lubricity. This lower quality of lubricity is also seen with adipate esters of branched alcohols. Since low molecular weight linear esters also have low viscosities, some degree of branching is required to build viscosity while maintaining good cold flow properties. When both the alcohol and acid portions of the ester are highly branched, however, such as with the case of polyol esters of highly branched oxo acids, the resulting molecule tends to exhibit poor biodegradation as measured by the Modified Sturm test (OECD Test No. 301B).

In an article by Randles and Wright, "Environmentally Considerate Ester Lubricants for the Automotive and Engineering Industries", *Journal of Synthetic Lubrication,* Vol. 9-2, pp. 145–161, it was stated that the main features which slow or reduce microbial breakdown are the extent of branching, which reduces β-oxidation, and the degree to which ester hydrolysis is inhibited. The negative effect on biodegradability due to branching along the carbon chain is further discussed in a book by R. D. Swisher, "Surfactant Biodegradation", Marcel Dekker, Inc., Second Edition, 1987, pp. 415–417. In his book, Swisher stated that "The results clearly showed increased resistance to biodegradation with increased branching . . . Although the effect of a single methyl branch in an otherwise linear molecule is barely noticeable, increased resistance [to biodegradation] with increased branching is generally observed, and resistance becomes exceptionally great when quaternary branching occurs at all chain ends in the molecule." The negative effect of alkyl branching on biodegradability was also discussed in an article by N. S. Battersby, S. E. Pack, and R. J. Watkinson, "*A Correlation Between the Biodegradability of Oil Products in the CEC-L-33-T-82 and Modified Sturm Tests*", Chemosphere, 24(12), pp. 1989–2000 (1992).

Initially, the poor biodegradation of branched polyol esters was believed to be a consequence of the branching and, to a lesser extent, to the insolubility of the molecule in water. However, recent work by the present inventors has shown that the non-biodegradability of these branched esters is more a function of steric hindrance than of the micro-organism's inability to breakdown the tertiary and quaternary carbons. Thus, by relieving the steric hindrance around the ester linkage(s), biodegradation can more readily occur with branched esters.

Branched synthetic polyol esters have been used extensively in non-biodegradable applications, such as refrigeration lubricant applications, and have proven to be quite effective if 3,5,5-trimethylhexanoic acid is incorporated into the molecule at 25 molar percent or greater. However, trimethylhexanoic acid is not biodegradable as determined by the Modified Sturm test (OECD 301B), and the incorporation of 3,5,5-trimethylhexanoic acid, even at 25 molar percent, would drastically lower the biodegradation of the polyol ester due to the quaternary carbons contained therein.

Likewise, incorporation of trialkyl acetic acids (i.e., neo acids) into a polyol ester produces very useful refrigeration lubricants. These acids do not, however, biodegrade as determined by the Modified Sturm test (OECD 301B) and cannot be used to produce polyol esters for biodegradable applications. Polyol esters of all branched acids can be used as refrigeration oils as well. However, they do not rapidly biodegrade as determined by the Modified Sturm Test (OECD 301B) and, therefore, are not desirable for use in biodegradable applications.

Although polyol esters made from purely linear $C_5$ and $C_{10}$ acids for refrigeration applications would be biodegradable under the Modified Sturm test, they would not work as a lubricant in hydraulic or two-cycle engine applications because the viscosities would be too low and wear additives would be needed. It is extremely difficult to develop a lubricant base stock which is capable of exhibiting all of the various properties required for biodegradable lubricant applications, i.e., high viscosity, low pour point, oxidative stability and biodegradability as measured by the Modified Sturm test.

U.S. Pat. No. 4,826,633 (Carr et al.), which issued on May 2, 1989, discloses a synthetic ester lubricant base stock formed by reacting at least one of trimethylolpropane and monopentaerythritol with a mixture of aliphatic monocarboxylic acids. The mixture of acids includes straight-chain acids having from 5 to 10 carbon atoms and an iso-acid having from 6 to 10 carbon atoms, preferably iso-nonanoic acid (i.e., 3,5,5-trimethylhexanoic acid). This base stock is mixed with a conventional ester lubricant additive package to form a lubricant having a viscosity at 99° C. (210° F.) of at least 5.0 centistokes and a pour point of at least as low as −54° C. (−65° F.). This lubricant is particularly useful in gas turbine engines. The Carr et al. patent differs from the present invention for two reasons. Firstly, it preferably uses as its branched acid 3,5,5-trimethylhexanoic acid which contains a quaternary carbon in every acid molecule. The incorporation of quaternary carbons within the 3,5,5-trimethylhexanoic acid inhibits biodegradation of the polyol ester product. Also, since the lubricant according to Carr et al. exhibits high stability, as measured by a high pressure differential scanning calorimeter (HPDSC), i.e., about 35 to 65 minutes, the micro-organisms cannot pull them apart. Conversely, the lubricant according to the present invention is low in stability, i.e., it has a HPDSC reading of about 12–17 minutes. The lower stability allows the micro-organisms to attack the carbon-to-carbon bonds about the polyol structure and effectively cause the ester to biodegrade. One reason that the lubricant of the present invention is lower is stability is the fact that no more than 10% of the branched acids used to form the lubricant's ester base stock contain a quaternary carbon.

Therefore, the present inventors have discovered that highly biodegradable lubricants using biodegradable base stocks with good cold flow properties, good solubility with dispersants, and good lubricity can be achieved by incorporating branched acids into the ester molecule. The branched acids used in accordance with the present invention are needed to build viscosity and the multiple isomers in these acids are helpful in attaining low temperature properties. That is, the branched acids allow the chemist to build viscosity without increasing molecular weight. Furthermore, branched biodegradable lubricants provide the following cumulative advantages over all linear biodegradable lubricants: (1) decreased pour point; (2) increased solubilities of other additives; (3) increased detergency/dispersancy of the lubricant oil; and (4) increased oxidative stability.

Moreover, the biodegradable synthetic ester base stock according to the present invention has an oxygen to carbon ratio which allows the ester to burn cleaner, producing less smoke in two-cycle, air-cooled engine lubricant formulations. That is, the ratio of oxygen to carbon in the ester base stock of the present invention is substantially higher than conventional esters, e.g., esters of trimethylolpropane (TMP) reacted isostearate or rapeseed oil, which exhibit an oxygen to carbon ratio of approximately 0.1:1.

U.S. Pat. No. 5,308,524 (Miyaji et al.), which issued May 3, 1994, is directed to a biodegradable lubricating oil composition for two-cycle or rotary engines. One of the examples of Miyaji et al. is an ester base stock of pentaerythritol with iso-$C_8$ monobasic fatty acid and n-$C_{10}$ monobasic fatty acid which exhibited a kinematic viscosity of 39.9 cSt at 40° C. and a biodegradability of 98% under the CEC test. It should be noted that the CEC test is not nearly as reliable as the Modified Sturm test in detecting biodegradability. Since the viscosity of an ester of pentaerythritol and iso-$C_8$ acid is approximately 50 cSt at 40° C. and the viscosity of an ester of pentaerythritol and n-$C_{10}$ acid is about 38.6 cSt at 40° C., the ester of pentaerythritol and a mixture of iso-$C_8$ and n-$C_{10}$ acids as disclosed in Miyaji et al. would only include about 10% or less iso-$C_8$ acid in order to obtain a viscosity of 39.9 cSt at 40° C. It is known to one of ordinary skill in the art that esters having low amounts of branched acids, i.e., 10% or less, may be biodegradable such as that disclosed in Miyaji et al. The present invention, however, is directed to a biodegradable ester base stock having mixed acids comprising about 30 to 80 molar % of a linear acid having a carbon number in the range between about $C_5$ to $C_{12}$, and about 20 to 70 molar % of at least one branched acid having a carbon number in the range between about $C_5$ to $C_{10}$. It is not known to those skilled in the art to use such large percentages of branched acids and still produce a product which exhibits at least 60% biodegradation in 28 days as measured by the Modified Sturm test. In fact, conventional wisdom would teach away from using 20 to 70 molar % of a branched acid in the synthesis of a biodegradable ester base stock. Furthermore, the ester base stock of Miyaji et al. having 10% of an iso-$C_8$ acid would not meet the low temperature property requirements of the present invention, i.e., a pour point of less than −25° C., preferably less than −40° C., and a viscosity of less than 7500 cps at −25° C. That is, the ester base stock disclosed in Miyaji et al. would be solid at −25° C. or less.

The data compiled by the present inventors and set forth in the examples to follow show that all of the above listed properties can be best met with biodegradable lubricants formulated with biodegradable synthetic ester base stocks which incorporate both highly branched acids and linear acids.

SUMMARY OF THE INVENTION

A biodegradable synthetic base stock which preferably comprises the reaction product of: a branched or linear alcohol having the general formula $R(OH)_n$, wherein R is an aliphatic or cyclo-aliphatic group having from about 2 to 20 carbon atoms (preferably an alkyl) and n is at least 2 and up to about 10; and mixed acids comprising about 30 to 80 molar %, more preferably about 35 to 55 mole %, of a linear acid having a carbon number (i.e., carbon number means the total number of carbon atoms in either the acid or alcohol as the case may be) in the range between about $C_5$ to $C_{12}$, more preferably about $C_7$ to $C_{10}$; and about 20 to 70 molar %, more preferably about 35 to 55 mole %, of at least one branched acid having a carbon number in the range between about $C_5$ to $C_{13}$, more preferably about $C_7$ to $C_{10}$; wherein the ester has an oxygen to carbon ratio of between about 0.15:1 to 0.3:1 and exhibits the following properties: at least 60% biodegradation in 28 days as measured by the Modified Sturm test; a pour point of less than −25° C.; a viscosity of less than 7500 cps at −25° C.; and oxidative stability of up to 45 minutes as measured by HPDSC.

In the most preferred embodiment, it is desirable to have a branched acid comprising multiple isomers, preferably more than 3 isomers, most preferably more than 5 isomers. The linear acid is preferably an alkyl mono- or di-carboxylic acid having the general formula RCOOH, wherein R is an n-alkyl having between about 4 to 11 carbon atoms, more preferably between about 7 to 10 carbon atoms. It is also preferable that no more than 10% of the branched acids used to form the biodegradable synthetic ester base stock contain a quaternary carbon.

These biodegradable synthetic base stocks are particularly useful in the formulation of biodegradable two-cycle, air-cooled engine lubricant formulations since they have an oxygen to carbon ratio of approximately 0.2:1, preferably in the range between about 0.15:1 to 0.3:1, which burns cleaner, thereby producing less smoke.

The formulated biodegradable lubricants according to the present invention preferably comprise about 60–99.5% by weight of at least one biodegradable lubricant synthetic base stock discussed above, about 1 to 20% by weight lubricant additive package, and about 0.5 to 20% of a solvent.

The biodegradable lubricants of the present invention also exhibit the following properties: (1) very low toxicity; (2) enhanced oxidative stability; and (3) neutral to seal swelling.

DESCRIPTION OF THE PREFERRED EMBODIMENTS

The branched synthetic ester base stock used in the formulation of various biodegradable lubricants and oils in accordance with the present invention is preferably formed from the reaction product of technical grade pentaerythritol, which comprises between about 86–92% mono-pentaerythritol, 6–12% di-pentaerythritol and 1–3% tri-pentaerythritol, with approximately 45–70 molar $C_8$ and $C_{10}$ linear acids ("C810" linear acids) and approximately 30–55 molar % iso-$C_8$ (e.g., Cekanoic 8) branched acids.

Neopentyl glycol (NPG) can be totally esterified with 2-ethylhexanoic acid or an iso-C8 acid and still maintain about 90% biodegradation as measured by the Modified Sturm test. After two branched acids have been added to a branched polyol, the ester linkages begin to become crowded around the quaternary carbon of the branched alcohol. Additional branched acids added to the branched alcohol begin to lower the biodegradation of the molecule such that by the fourth addition of a branched acid to the branched alcohol, the biodegradation of the resulting molecule drops from about 80% to less than 15% biodegradation as measured by the Modified Sturm test.

Introduction of linear acids into the molecule relieves the steric crowding around the quaternary carbon of the branched alcohol. Thus, by having two branched acids and two linear acids on pentaerythritol, for example, the enzymes have access to the ester linkages, and the first stage of biodegradation, i.e., the hydrolysis of the ester, can occur. In each of the pentaerythritol esters, the hydroxyl groups are esterified with the various branched and linear acids.

ALCOHOLS

Among the alcohols which can be reacted with the branched and linear acids of the present invention are, by way of example, polyols (i.e., polyhydroxyl compounds) represented by the general formula:

$$R(OH)_n$$

wherein R is any aliphatic or cyclo-aliphatic hydrocarbyl group (preferably an alkyl) and n is at least 2. The hydrocarbyl group may contain from about 2 to about 20 or more carbon atoms, and the hydrocarbyl group may also contain substituents such as chlorine, nitrogen and/or oxygen atoms. The polyhydroxyl compounds generally will contain from about 2 to about 10 hydroxyl groups and more preferably from about 2 to about 6 hydroxy groups. The polyhydroxy compound may contain one or more oxyalkylene groups and, thus, the polyhydroxy compounds include compounds such as polyetherpolyols. The number of carbon atoms (i.e., carbon number) and number of hydroxy groups (i.e., hydroxyl number) contained in the polyhydroxy compound used to form the carboxylic esters may vary over a wide range.

The following alcohols are particularly useful as polyols: neopentyl glycol, 2,2-dimethylol butane, trimethylol ethane, trimethylol propane, trimethylol butane, mono-pentaerythritol, technical grade pentaerythritol, di-pentaerythritol, ethylene glycol, propylene glycol and polyalkylene glycols (e.g., polyethylene glycols, polypropylene glycols, polybutylene glycols, etc., and blends thereof such as a polymerized mixture of ethylene glycol and propylene glycol).

The preferred branched or linear alcohols are selected from the group consisting of: technical grade pentaerythritol, mono-pentaerythritol, di-pentaerythritol, neopentylglycol, trimethylol propane, trimethylol ethane and propylene glycol, 1,4-butanediol, sorbitol and the like, and 2-methylpropanediol. The most preferred alcohol is technical grade (i.e., 88% mono, 10% di and 1–2% tri) pentaerythritol.

BRANCHED ACIDS

The branched acid is preferably a mono-carboxylic acid which has a carbon number in the range between about $C_5$ to $C_{13}$, more preferably about $C_7$ to $C_{10}$ wherein methyl branches are preferred. The preferred branched acids are those wherein less than or equal to 10% of the branched acids contain a quaternary carbon. The mono-carboxylic acid is at least one acid selected from the group consisting of: 2-ethylhexanoic acids, isoheptanoic acids, iso-octanoic acids, iso-nonanoic acids, iso-decanoic acids, and α-branched acids. The most preferred branched acid is iso-octanoic acids, e.g., Cekanoic 8 acid. The branched acid is predominantly a doubly branched or an alpha branched acid having an average branching per molecule in the range between about 0.3 to 1.9.

It is desirable to have a branched acid comprising multiple isomers, preferably more than 3 isomers, most preferably more than 5 isomers.

LINEAR ACIDS

The preferred mono- and/or di-carboxylic linear acids are any linear, saturated alkyl carboxylic acids having a carbon number in the range between about 5 to 12, preferably 7 to 10. The most preferred linear acids are mono-carboxylic acids.

Some examples of linear acids include n-heptanoic, n-octanoic, n-decanoic and n-nonanoic acids. Selected diacids include adipic, azelaic, sebacic and dodecanedioic acids. For the purpose of modifying the viscosity of the resultant ester product, up to 20 wt. % of the total acid mixture can consist of linear di-acids.

BIODEGRADABLE LUBRICANTS

The branched synthetic ester base stock can be used in the formulation of biodegradable lubricants together with selected lubricant additives. The additives listed below are typically used in such amounts so as to provide their normal attendant functions. Typical amounts for individual components are also set forth below. The preferred biodegradable lubricant contains approximately 80% or greater by weight of the base stock and 20% by weight of any combination of the following additives:

| | (Broad) Wt. % | (Preferred) Wt. % |
|---|---|---|
| Viscosity Index Improver | 1–12 | 1–4 |
| Corrosion Inhibitor | 0.01–3 | 0.01–1.5 |
| Oxidation Inhibitor | 0.01–5 | 0.01–1.5 |
| Dispersant | 0.1–10 | 0.1–5 |
| Lube Oil Flow Improver | 0.01–2 | 0.01–1.5 |
| Detergents and Rust Inhibitors | 0.01–6 | 0.01–3 |
| Pour Point Depressant | 0.01–1.5 | 0.01–1.5 |
| Antifoaming Agents | 0.001–0.1 | 0.001–0.01 |
| Antiwear Agents | 0.001–5 | 0.001–1.5 |
| Seal Swellant | 0.1–8 | 0.1–4 |
| Friction Modifiers | 0.01–3 | 0.01–1.5 |
| Biodegradable Synthetic Ester Base Stock | ≧80% | ≧80% |

When other additives are employed, it may be desirable, although not necessary, to prepare additive concentrates comprising concentrated solutions or dispersions of the dispersant (in concentrated amounts hereinabove described), together with one or more of the other additives (concentrate when constituting an additive mixture being referred to herein as an additive package) whereby several additives can be added simultaneously to the base stock to form the lubricating oil composition. Dissolution of the additive concentrate into the lubricating oil may be facilitated by solvents and by mixing accompanied with mild heating, but this is not essential. The concentrate or additive-package will typically be formulated to contain the dispersant additive and optional additional additives in proper amounts to provide the desired concentration in the final formulation when the additive package is combined with a predetermined amount of base lubricant or base stock. Thus, the biodegradable lubricants according to the present invention can employ typically up to about 20 wt. % of the additive package with the remainder being biodegradable ester base stock and/or a solvent.

All of the weight percents expressed herein (unless otherwise indicated) are based on active ingredient (A.I.) content of the additive, and/or upon the total weight of any additive-package, or formulation which will be the sum of the A.I. weight of each additive plus the weight of total oil or diluent.

Examples of the above additives for use in biodegradable lubricants are set forth in the following documents which are incorporated herein by reference: U.S. Pat. No. 5,306,313 (Emert et al.), which issued on Apr. 26, 1994; U.S. Pat. No. 5,312,554 (Waddoups et al.), which issued on May 17, 1994; U.S. Pat. No. 5,328,624 (Chung), which issued Jul. 12, 1994; an article by Benfaremo and Liu, "Crankcase Engine Oil Additives", *Lubrication,* Texaco Inc., pp. 1–7; and an article by Liston, "Engine Lubricant Additives What They are and How They Function", *Lubrication Engineering,* May 1992, pp. 389–397.

Viscosity modifiers impart high and low temperature operability to the lubricating oil and permit it to remain shear stable at elevated temperatures and also exhibit acceptable viscosity or fluidity at low temperatures. These viscosity modifiers are generally high molecular weight hydrocarbon polymers including polyesters. The viscosity modifiers may also be derivatized to include other properties or functions, such as the addition of dispersancy properties. Representative examples of suitable viscosity modifiers are any of the types known to the art including polyisobutylene, copolymers of ethylene and propylene, polymethacrylates, methacrylate copolymers, copolymers of an unsaturated dicarboxylic acid and vinyl compound, interpolymers of styrene and acrylic esters, and partially hydrogenated copolymers of styrene/isoprene, styrene/butadiene, and isoprene/butadiene, as well as the partially hydrogenated homopolymers of butadiene and isoprene.

Corrosion inhibitors, also known as anti-corrosive agents, reduce the degradation of the metallic parts contacted by the lubricating oil composition. Illustrative of corrosion inhibitors are phosphosulfurized hydrocarbons and the products obtained by reaction of a phosphosulfurized hydrocarbon with an alkaline earth metal oxide or hydroxide, preferably in the presence of an alkylated phenol or of an alkylphenol thioester, and also preferably in the presence of an alkylated phenol or of an alkylphenol thioester, and also preferably in the presence of carbon dioxide. Phosphosulfurized hydrocarbons are prepared by reacting a suitable hydrocarbon such as a terpene, a heavy petroleum fraction of a $C_2$ to $C_6$ olefin polymer such as polyisobutylene, with from 5 to 30 wt. % of a sulfide of phosphorus for ½ to 15 hours, at temperatures in the range of about 66° to about 316° C. Neutralization of the phosphosulfurized hydrocarbon may be effected in the manner taught in U.S. Pat. No. 1,969,324.

Oxidation inhibitors, or antioxidants, reduce the tendency of mineral oils to deteriorate in service which deterioration can be evidenced by the products of oxidation such as sludge and varnish-like deposits on the metal surfaces, and by viscosity growth. Such oxidation inhibitors include alkaline earth metal salts of alkyl-phenolthioesters having preferably $C_5$ to $C_{12}$ alkyl side chains, e.g., calcium nonylphenol sulfide, barium octylphenylsulfide, dioctylphenylamine, phenylalphanaphthylamine, phosphosulfurized or sulfurized hydrocarbons, etc.

Friction modifiers serve to impart the proper friction characteristics to lubricating oil compositions such as automatic transmission fluids. Representative examples of suitable friction modifiers are fatty acid esters and amides, molybdenum complexes of polyisobutenyl succinic anhydride-amino alkanols, glycerol esters of dimerized fatty acids, alkane phosphortic acid salts, phosphonate with an oleamide, S-carboxyalkylene hydrocarbyl succinimide, N(hydroxylalkyl)alkenylsuccinamic acids or succinimides, di-(lower alkyl) phosphites and epoxides, and alkylene oxide adduct of phosphosulfufized N-(hydroxyalkyl)alkenyl succinimides. The most preferred friction modifiers are succinate esters, or metal salts thereof, of hydrocarbyl substituted succinic acids or anhydrides and thiobis-alkanols.

Dispersants maintain oil insolubles, resulting from oxidation during use, in suspension in the fluid thus preventing sludge flocculation and precipitation or deposition on metal parts. Suitable dispersants include high molecular weight alkyl succinimides, the reaction product of oil-soluble polyisobutylene succinic anhydride with ethylene amines such as tetraethylene pentamine and borated salts thereof.

Still other dispersants of the ashless type can also be used to in lubricant and fuel compositions. One such ashless dispersant is a derivatized hydrocarbon composition which is mixed with at least one of amine, alcohol, including polyol, aminoalcohol, etc. The preferred derivatized hydrocarbon dispersant is the product of reacting (1) a functionalized hydrocarbon of less than 500 Mn wherein functionalization comprises at least one group of the formula —CO—Y—$R^3$ wherein Y is O or S; $R^3$ is H, hydrocarbyl, aryl, substituted aryl or substituted hydrocarbyl and wherein at least 50 mole % of the functional groups are attached to a tertiary carbon atom; and (2) a nucleophilic reactant; wherein at least about 80% of the functional groups originally present in the functionalized hydrocarbon are derivatized.

The functionalized hydrocarbon or polymer may be depicted by the formula:

$$\text{POLY-}(CR^1R^2\text{—CO—Y—}R^3)_n$$

wherein POLY is a hydrocarbon, including an oligomer or polymer backbone having a number average molecular weight of less than 500, n is a number greater than 0, $R^1$, $R^2$ and $R^3$ may be the same or different and are each H, hydrocarbyl with the proviso that either $R^1$ and $R^2$ are selected such that at least 50 mole percent of the —$CR^1R^2$ groups wherein both $R^1$ and $R^2$ are not H, or $R^3$ is aryl substituted hydrocarbyl.

The above functionalized dispersants are more fully described in co-pending U.S. patent application Ser. No. 08/261,558, filed on Jun. 17, 1994, and which is incorporated herein by reference.

Pour point depressants, otherwise known as lube oil flow improvers, lower the temperature at which the fluid will flow or can be poured. Such additives are well known. Typical of those additives which usually optimize the low temperature fluidity of the fluid are $C_8$ to $C_{18}$ dialkylfumarate vinyl acetate copolymers, polymethacrylates, and wax naphthalene. Foam control can be provided by an antifoamant of the polysiloxane type, e.g., silicone oil and polydimethyl siloxane.

Antiwear agents, as their name implies, reduce wear of metal parts. Representative of conventional antiwear agents are zinc dialkyldithiophosphate and zinc diaryldithiosphate.

Antifoam agents are used for controlling foam in the lubricant. Foam control can be provided by an antifoamant of the high molecular weight dimethylsiloxanes and polyethers. Some examples of the polysiloxane type antifoamant are silicone oil and polydimethyl siloxane.

Detergents and met. al rust inhibitors include the metal salts of sulphonic acids, alkyl phenols, sulfurized alkyl phenols, alkyl salicylates, naphthenates and other oil soluble mono- and di-carboxylic acids. Highly basic (viz. overbased) metal salts, such as highly basic alkaline earth metal sulfonates (especially Ca and Mg salts) are frequently used as detergents.

Seal swellants include mineral oils of the type that provoke swelling of engine seals, including aliphatic alcohols of 8 to 13 carbon atoms such as tridecyl alcohol, with a preferred seal swellant being characterized as an oil-soluble, saturated, aliphatic or aromatic hydrocarbon ester of from 10 to 60 carbon atoms and 2 to 4 linkages, e.g., dihexyl phthalate, as are described in U.S. Pat. No. 3,974,081, which is incorporated by reference.

BIODEGRADABLE TWO-CYCLE ENGINE OILS

The branched synthetic ester base stock can be used in the formulation of biodegradable two-cycle engine oils together with selected lubricant additives. The preferred biodegradable two-cycle engine oil is typically formulated using the biodegradable synthetic ester base stock formed according to the present invention together with any conventional two-cycle engine oil additive package. The additives listed below are typically used in such amounts so as to provide their normal attendant functions. The additive package may include, but is not limited to, viscosity index improvers, corrosion inhibitors, oxidation inhibitors, coupling agents, dispersants, extreme pressure agents, color stabilizers, surfactants, diluents, detergents and rust inhibitors, pour point depressants, antifoaming agents, and antiwear agents.

The biodegradable two-cycle engine oil according to the present invention can employ typically about 75 to 85% base stock, about 1 to 5% solvent, with the remainder comprising an additive package.

When used in biodegradable two-cycle, air-cooled engine lubricant formulations, the biodegradable synthetic ester base stock preferably has an oxygen to carbon ratio of approximately 0.2:1, preferably in the range between about 0.15:1 to 0.3:1, which burns cleaner, thereby producing less smoke.

Examples of the above additives for use in biodegradable lubricants are set forth in the following documents which are incorporated herein by reference: U.S. Pat. No. 5,663,063 (Davis), which issued on May 5, 1987; U.S. Pat. No. 5,330,667 (Tiffany, III et al.), which issued on Jul. 19, 1994; U.S. Pat. No. 4,740,321 (Davis et al.), which issued on Apr. 26, 1988; U.S. Pat. No. 5,321,172 (Alexander et al.), which issued on Jun. 14, 1994; and U.S. Pat. No. 5,049,291 (Miyaji et al.), which issued on Sep. 17, 1991.

One such biodegradable two cycle engine oil comprises:

(a) a major portion of at least one biodegradable synthetic ester base stock which comprises the reaction product of: a branched or linear alcohol having the general formula $R(OH)_n$, wherein R is an aliphatic or cycloaliphatic group having from about 2 to 20 carbon atoms and n is at least 2; and mixed acids comprising about 30 to 80 molar % of a linear acid having a carbon number in the range between about $C_5$ to $C_{12}$, and about 20 to 70 molar % of at least one branched acid having a carbon number in the range between about $C_5$ to $C_{13}$; wherein the ester base stock exhibits the following properties: at least 60% biodegradation in 28 days as measured by the Modified Sturm test; a pour point of less than −25° C.; and a viscosity of less than 7500 cps at −25° C.;

(b) from about 3 to about 15 wt. %, based on lubricant composition of a bright stock having a kinematic viscosity of about 20 to about 40 cSt at 100° C.;

(c) from about 3 to about 15 wt. %, based on lubricant composition of a polyisobutylene having a number average molecular weight of from about 400 to about 1050; and (d) from about 3 to about 15 wt. % of a polyisobutylene having a number average molecular weight from about 1150 to about 1650.

Another such biodegradable two cycle engine oil comprises:

(a) a major portion of at least one biodegradable synthetic ester base stock which comprises the reaction product of: a branched or linear alcohol having the general formula $R(OH)_n$, wherein R is an aliphatic or cycloaliphatic group having from about 2 to 20 carbon atoms and n is at least 2; and mixed acids comprising about 30 to 80 molar % of a linear acid having a carbon number in the range between about $C_5$ to $C_{12}$, and about 20 to 70 molar % of at least one branched acid having a carbon number in the range between about $C_5$ to $C_{13}$; wherein the ester base stock exhibits the following properties: at least 60% biodegradation in 28 days as measured by the Modified Sturm test; a pour point of less than −25° C.; and a viscosity of less than 7500 cps at −25° C.; and (b) an additive concentration comprising: (1) about 4 to 40 volume % of an amide/imidazoline or amide/imide/imidazoline dispersant; (2) about 5 to 50 volume % of a succinimide dispersant, at least one of the dispersant (1) or (2) being borated; (3) about 1 to 60 volume % of a polyolefin thickener, and optionally; (4) about 0.1 to 5 volume % of an alkylphenyol sulphide; and (5) about 0.1 to 5 volume % of a phosphorous-containing anti-wear agent. Treat rates for the additive package in finished oil can range from about 5 to about 60 percent by volume and preferably from about 35 to about 50 percent by volume of the concentrate. (See U.S. Pat. No. 5,330,667 (Tiffany, III et al.) which is incorporated herein by reference).

Still another biodegradable two cycle engine oil comprises:

(a) a major portion of at least one biodegradable synthetic ester base stock which comprises the reaction product of: a branched or linear alcohol having the general formula $R(OH)_n$, wherein R is an aliphatic or cycloaliphatic group having from about 2 to 20 carbon atoms and n is at least 2; and mixed acids comprising about 30 to 80 molar % of a linear acid having a carbon number in the range between about $C_5$ to $C_{12}$, and about 20 to 70 molar % of at least one branched acid having a carbon number in the range between about $C_5$ to $C_{13}$; wherein the ester base stock exhibits the following properties: at least 60% biodegradation in 28 days as measured by the Modified Sturm test; a pour point of less than −25° C.; and a viscosity of less than 7500 cps at −25° C.; and (b) at least one amide/imidazoline-containing dispersant prepared by reacting a monocarboxylic acid acylating agent with a polyamine, and, optionally, a high molecular weight acylating agent. Such dispersants can also comprise imide moieties formed when the high molecular weight acylating agent is an appropriate diacid or anhydride thereof.

Another additive which may be admixed with the biodegradable base stock of the present invention to form a formulated two cycle engine oil comprises the combination of:

(a) at least one alkyl phenol of the formula $$(R)_a—Ar—(OH)_b$$

wherein each R is independently a substantially saturated hydrocarbon-based group of an average of at least about 10 aliphatic carbon atoms; a and b are each independently an integer of one up to three times the number of aromatic nuclei present in Ar with the proviso that the sum of a and b does not exceed the unsatisfied valences of Ar; and Ar is an aromatic moiety which is a single ring, a fused ting or a linked polynuclear ring having 0 to 3 optional substituents selected from the group consisting essentially of lower alkyl, lower alkoxyl, carboalkoxy methylol or lower hydrocarbon-based substituted methylol, nitro, nitroso, halo and combination of the optional substituents; and (b) at least one amino compound with the proviso that the amino compound is not an amino phenyl. (See U.S. Pat. No. 4,663,063 (Davis) which is incorporated herein by reference.

A preferred dispersant for two-cycle oil formulations comprises a major amount of at least one oil of lubricating viscosity and a minor amount of a functionalized and derivatized hydrocarbon; wherein functionalization comprises at least one group of the formula $—CO—Y—R^3$ wherein Y is O or S; $R^3$ is aryl, substituted aryl or substituted hyrdocarbyl, and $—Y—R^3$ has a pKa of 12 or less; wherein at least 50 mole % of the functional groups are attached to a tertiary carbon atom; and wherein said functionalized hydrocarbon is derivatized by a nucleophilic reactant. The nucleophilic reactant is selected from the group consisting of alcohols and amines.

Finally, another two-cycle oil dispersant additive which substantially avoids the formation of gelled agglomerates at low temperatures but which correspondingly provides effective engine cleanliness, detergency, lubricity and wear inhibition. It has been discovered that a two-cycle oil additive comprising a nitrogen-containing compound prepared by reacting (A) at least one high molecular weight substituted carboxylic acid acylating agent with (B) at least one polyalkylene polyamine and (C) at least one monocarboxylic acid wherein the molar ratio of the monocarboxylic acid to high molecular weight substituted acylating agent is at least 3:1. This dispersant preferably contains oil soluble hydrocarbon moiety(ies) connected to polar moieties which are substantially comprised of tertiary amines, preferably imidazoline heterocycles, and wherein the ratio of tertiary amine to total amine is at least about 0.7:1. The additive remains stable to the formation of the gelled agglomerants, especially during prolong storage at low temperatures (0° C. or less).

EXAMPLE 1

The following are conventional ester base stocks which do not exhibit satisfactory properties for use as biodegradable lubricants. The properties listed in Tables 1 and 2 were determined as follows. Pour Point was determined using ASTM #D-97. Brookfield Viscosity at −25° C. was determined using ASTM #D-2983. Kinematic viscosity (@40 and 100° C.) was determined using ASTM #D-445. Viscosity index (VI) was determined using ASTM #D-2270. Biodegradation was determined using the Modified Sturm test (OECD Test No. 301B). Solubility with dispersant was determined by blending the desired ratios and looking for haze, cloudiness, two-phases, etc. Engine wear was determined using the NMMA Yamaha CE50S Lubricity test. Oxidation induction time was determined using a high pressure differential scanning calorimeter (HPDSC) having isothermal/isobaric conditions of 220° C. and 500 psi (3.445 MPa) air, respectively. Aquatic toxicity was determined using the Dispersion Aquatic Toxicity test. The acid number was determined using ASTM #D-664. The hydroxyl number of the respective samples was determined by infrared spectroscopy.

TABLE 1

| Base stock | Pour Point °C. | Vis @ −25° C. (cPs) | Vis. @ 40° C. (cSt) | Vis. @ 100° C. (cSt) | % Bio. | *Sol with Disp. | Engine Wear |
|---|---|---|---|---|---|---|---|
| Natural Oils | | | | | | | |
| Rapeseed Oil | 0 | Solid | 47.80 | 10.19 | 86.7 | n/a | n/a |
| All Linear Esters | | | | | | | |
| Di-undecyladipate | +21 | solid | 13.92 | 2.80 | n/a | n/a | n/a |
| Polyol w/Linear & Semi-Linear Acids | | | | | | | |
| TPE/C810/C7 acid | n/a | solid | 29.98 | 5.90 | n/a | n/a | n/a |
| TPE/DiPE/n-C7 | −45 | 1380 | 24.70 | 5.12 | 82.31 | H | Fail |
| TPE/C7 acid | −62 | 915 | 24.0 | 4.9 | 83.7 | H | Fail |
| TMP/n-C7,8,10 | −85 | 350 | 17.27 | 4.05 | 61.7** | C | Fail |
| TMP/C7 acid | −71 | 378 | 14.1 | 3.4 | 76.5 | C | Fail |
| Branched Adipates | | | | | | | |
| di-tridecyladipate | −62 | n/a | 26.93 | 5.33 | 65.99 | C | Fail |
| All Branched | | | | | | | |
| TPE/Iso-C8 acid | −46 | n/a | 61.60 | 8.2 | 13.33 | C | n/a |

*denotes solubility with dispersant: H = haze; C = clear.
**denotes the biodegradation for this material includes 15.5 wt. % dispersant.
n/a denotes information was not available.
TPE denotes technical grade pentaerythritol.
TMP denotes trimethylolpropane.
C810 denotes predominantly a mixture of n-octanoic and n-decanoic acids, and may include small amounts of n-$C_6$ and n-$C_{12}$ acids. A typical sample of C810 acid may contain, e.g., 3–5% n-$C_6$, 48–58% n-$C_8$, 36–42% n-$C_{10}$, and 0.5–1% n-$C_{12}$.
n-C7,8,10 denotes a blend of linear acids with 7, 8 and 10 carbon atoms, e.g., 37% mole % n-$C_7$ acid, 39 mole % $C_8$ acid, 21 mole % $C_{10}$ acid and 3 mole % $C_6$ acid.
C7 denotes a $C_7$ acid produced by cobalt catalyzed oxo reaction of hexene-1, that is 70% linear and 30% α-branched. The composition includes approximately 70% n-heptanoic acid, 22% 2-methylhexanoic acid, 6.5% 2-ethylpentanoic acid, 1% 4-methylhexanoic acid, and 0.5% 3.3-dimethylpentanoic acid.

The properties of the branched ester base stock according to the present invention were compared against various conventional biodegradable lubricant base stocks and the results are set forth below in Table 2.

TABLE 2

| Property | TPE/Ck8/C810 | Rapeseed Oil | DTDA | TMP/iC18 |
|---|---|---|---|---|
| Pour Point (°C.) | −45 | 0 | −54 | −20 |
| Flash Point (°C.) | 274 | 162 | 221 | n/a |
| −25° C. Viscosity (cps) | 3600 | solid | n/a | 358,000 |
| 40° C. Viscosity (cSt) | 38.78 | 47.80 | 26.93 | 78.34 |
| 100° C. Viscosity (cSt) | 6.68 | 10.19 | 5.33 | 11.94 |
| Viscosity Index | 128 | 208 | 135 | 147 |
| Oxidation Induction Time* | 15.96 | 2.12 | 3.88 | 4.29 |
| Lubricity (Yamaha Engine) | Pass | n/a | Fail | Pass |
| % Biodegradation (Mod. Sturm) | ~85% | ~85% | ~60% | ~65% |
| Toxicity (LC50, ppm) | >5000 | >5000 | <1000 | n/a |
| Solubility with Dispersant | soluble | n/a | soluble | n/a |
| Acid Number (mgKOH/g) | 0.01 | 0.35 | 0.04 | 1.9 |
| Hydroxyl Number (mgKOH/g) | 1.91 | n/a | 1.49 | n/a |

*Oxidation Induction Time is the amount of time (in minutes) for a molecule to oxidatively decompose under a particular set of conditions using a high pressure differential scanning calorimeter (HPDSC). The longer it takes (the greater the number of minutes), the more stable the molecule. This shows that the molecule of the present invention is almost four times more oxidatively stable than any of the materials currently in use. The conditions used to evaluate these molecules were: 220° C. and 500 psi (3.447 MPa) air.

TABLE 2-continued

| Property | TPE/Ck8/C810 | Rapeseed Oil | DTDA | TMP/iC18 |
|---|---|---|---|---|

~ denotes approximately.
> denotes greater than.
< denotes less than.
DTDA denotes di-tridecyladipate.
TMP/iC18 denotes tri-ester of trimethylol propane and isostearic acid.
TPE denotes technical grade pentaerythritol.
TMP denotes trimethylolpropane.
C810 denotes a mixture of 3–5% n-C6, 48–58% n-C8, 36–42% n-C10, and 0.5–1.0% n-C12 acids.
Ck8 denotes Cekanoic-8 acid comprising a mixture of 26 wt. % 3,5-dimethyl hexanoic acid, 19 wt. % 45-dimethyl hexanoic acid, 17% 3,4-dimethyl hexanoic acid, 11 wt. % 5-methyl heptanoic acid, 5 wt. % 4 methyl heptanoic acid, and 22 wt. % of mixed methyl heptanoic acids and dimethyl hexanoic acids.

The data set forth in Table 2 above demonstrates that the TPE/C810/Ck8 biodegradable ester base stock according to the present invention is superior to rapeseed oil in cold flow properties and stability. The data also shows that the TPE/$C_{810}$/Ck8 biodegradable ester base stock is superior to di-tridecyladipate in stability, biodegradation, and aquatic toxicity. The ester base stock according to the present invention is also superior to TMP/iso-C18 in cold flow properties, stability, and biodegradation.

Rapeseed oil, a natural product, is very biodegradable, but it has very poor low temperature properties and does not lubricate very well due to its instability. Rapeseed oil is very unstable and breaks down in the engine causing deposit formation, sludge and corrosion problems. The di-undecyladipate, while probably biodegradable, also has very poor low temperature properties. Polyol esters of low molecular weight linear acids do not provide lubricity, and those of high molecular weight linear or semi-linear acids have poor low temperature properties. In addition, the pentaerythritol esters of linear acids are not soluble with polyamide dispersants. The di-tridecyladipate is only marginally biodegradable and, when blended with a dispersant that has low biodegradability, the formulated oil is only about 45% biodegradable. In addition, the di-tridecyladipate does not provide lubricity. Lower molecular weight branched adipates such as di-isodecyladipate, while more biodegradable, also do not provide lubricity and can cause seal swell problems. Polyol esters of trimethylolpropane or pentaerythritol and branched oxo acids do not biodegrade easily due to the steric hindrance discussed earlier.

EXAMPLE 2

The present inventors have discovered that highly biodegradable base stocks with good cold flow properties, good solubility with dispersants, and good lubricity can be achieved by incorporating branched acids into the ester molecule. The data set forth in Table 3 below demonstrates that all of the desired base stock properties can be best met with polyol esters incorporating 20 to 70% of a highly branched oxo acid and 30 to 80% of a linear acid.

50:50 molar ratio) were loaded into a reactor vessel and heated to 430° F. (221° C.) at atmospheric pressure. Thereafter, 75 lbs. (34 kg) of technical grade pentaerythritol were added to the acid mixture and the pressure was dropped until water began evolving. The water was taken overhead to drive the reaction. After about 6 hours of reaction time, the excess acids were removed overhead until a total acid number of 0.26 mgKOH/g was reached for the reaction product. The product was then neutralized and decolored for two hours at 90° C. with twice the stoichiometric amount of $Na_2CO_3$ (based on acid number) and 0.15 wt. % admix (based on amount in the reactor). The admix is a blend of 80 wt. % carbon black and 20 wt. % dicalite. After two hours at 90° C., the product was vacuum filtered to remove solids.

The properties set forth below in Table 4 were measured on the product:

TABLE 3

| Base stock | Pour Point °C. | Vis @ −25° C. (cPs) | Vis. @ 40° C. (cSt) | Vis. @ 100° C. (cSt) | % Bio | *Sol with Disp. | Engine Wear |
|---|---|---|---|---|---|---|---|
| TPE/C810/Ck8 | −36** | 7455** | 34.87 | 6.37 | 99.54 | C | Pass |
| TPE/C810/Ck8 and TMP/n-C7,8,10*** | −56 | 610 | 24.90 | 5.10 | 81.0 | C | Pass |
| TPE/C810/Ck8 and TPE/1770**** | −46 | 910 | 30.48 | 5.75 | 85.5 | H | Pass |

*Denotes solubility with dispersant: H = haze; C = clear.
**Denotes Pour Point and −25° C. Viscosity of Base stock with Dispersant.
***Denotes a 50:50 weight % ratio of TPE/C810/Ck8 and TMP/7810.
****Denotes a 50:50 weight % ratio of TPE/C810/Ck8 and TPE/1770.
1770 denotes a 70:30 mix of n-$C_7$ acid (70%) and alpha-branched $C_7$ acids (30%). The composition includes approximately 70% n-heptanoic acid, 22% 2-methylhexanoic acid, 6.5% 2-ethylpentanoic acid, 1% 4-methylhexanoic acid, and 0.5% 3.3-dimethylpentanoic acid.
TPE denotes technical grade pentaerythritol.
TMP denotes trimethylolpropane.
C810 denotes a mixture of 3–5% n-C6, 48–58% n-C8, 36–42% n-C10, and 0.5–1.0% n-C12 acids.
Ck8 denotes Cekanoic-8 acid comprising a mixture of 26 wt. % 3,5-dimethyl hexanoic acid, 19 wt. % 4,5-dimethyl hexanoic acid, 17% 3,4-dimethyl hexanoic acid, 11 wt. % 5-methyl heptanoic acid, 5 wt. % 4 methyl heptanoic acid, and 22 wt. % of mixed methyl heptanoic acids and dimethyl hexanoic acids.
n-C7,8,10 denotes a blend of linear acids with 7, 8 and 10 carbon atoms, e.g., 37% mole % n-$C_7$ acid, 39 mole % $C_8$ acid, 21 mole % $C_{10}$ acid and 3 mole % $C_6$ acid.

The data in Table 3 above shows that the polyol ester of technical grade pentaerythritol, iso-C8 and linear C810 acids can be used alone or in combination with other lower molecular weight esters as a biodegradable lubricant. These esters are particularly useful when lower viscosities are needed for a variety of biodegradable lubricant applications. The TPE/C810/Ck8 ester provides sufficient lubricity such that, even when diluted with other materials, it can meet the lubricity requirements without the addition of wear additives. When additives such as polyisobutylene, EP (extreme pressure) wear additives, corrosion inhibitors, or antioxidants are needed, the biodegradability of the final product can be reduced and the toxicity increased. If the base stock provides the needed properties without additives or if the additives needed can be minimized, the final product reflects the biodegradability and toxicity of the base stock, which in this case are high and low, respectively.

EXAMPLE 3

A sample of an ester base stock was prepared in accordance with the present invention wherein 220 lbs. (99.8 kg) of a C810 acid and 205 lbs. (93 kg) of Cekanoic 8 acid (a

TABLE 4

| | |
|---|---|
| Total Acid Number | 0.071 mgKOH/g |
| Specific Gravity | 0.9679 |
| Pour Point | −45° C. |
| ppm Water | 97 |
| Flash Point (COC) | 285° C. |
| Oxidation Induction Time (min.) | 15.96 |
| Viscosity @ −25° C. | 3950 cps |
| Viscosity @ 40° C. | 38.88 cSt |
| Viscosity @ 100° C. | 6.66 cSt |
| Viscosity Index | 127 |

An acid assay (saponification) was performed on the product in order to ascertain the amount of each acid actually on the molecule. Table 5 below sets forth the molar amounts of each acid on the product ester:

TABLE 5

| | |
|---|---|
| Cekanoic 8 Acid | 43.35% |
| n-$C_8$ Acid | 35.73% |
| n$C_{10}$ Acid | 20.92% |

This resultant ester product was then submitted with and without additives for biodegradation tests for application into the hydraulic fluid market. The additives were used at a 2–5 wt. % treat rate. The results are set forth below in Table 6.

TABLE 6

| Product | % Biodeg. | Standard Deviation | Meet 10 day Window |
|---|---|---|---|
| TPE/C810/Ck8 (alone) | 92.9 | ±7.0 | yes |
| TPE/C810/Ck8 + BIO SHP Adpack* | 80.5 | ±1.6 | no |
| TPE/C810/Ck8 + MGG Adpack*** | 75.4 | ±6.9 | no |
| TPE/C810/Ck8 + Synestic Adpack** | 76.8 | ±14.7 | no |

*Denotes a lubricant additive package sold by Exxon Company, USA, under the trademark Univis BIO SHP Adpack.
**Denotes a lubricant additive package sold by Exxon Chemical Company, Paramins Division under the trademark Synestic Adpack.
***Denotes a lubricant additive package sold by Exxon Company, USA under the trademark MGG Adpack.

The resultant ester base stock formed in accordance with this Example 3 was also blended at a 50:50 wt. % ratio with the ester TMP/7810. This blend was submitted with and without additives for biodegradation tests for application into the two-cycle engine oil market. The additives were used at a 14–16 wt. % treat rate. The results are set forth in Table 7 below.

TABLE 7

| Product | % Biodeg. | Standard Deviation |
|---|---|---|
| TPE/C810/Ck8 + TMP/7810 (50:50) | 80.7 | ±3.6 |
| TPE/C810/Ck8 + TMP/7810 + 14.5 wt. % Dispersant* | 76.1 | ±4.6 |

*The dispersant package comprising primarily of polyamides.

EXAMPLE 4

Table 8 below contains comparative data for all-linear and semi-linear esters verses the biodegradable synthetic ester base stock formed according to the present invention. We have provided two examples of the ester base stock according to the present invention because they contain two different molar ratios of Cekanoic 8 to C810. The results indicate that a certain amount of branching does not greatly affect biodegradation as measured by the Modified Sturm test and may, in fact, actually improve it which is contrary to conventional wisdom.

TABLE 8

| Ester | % Biodegradation (28 Days) | Standard Deviation | 10-Day Window |
|---|---|---|---|
| Totally Linear Ester | | | |
| TMP/7810 | 76.13 | 8.77 | no |
| TPE/Di-PE/n-$C_7$ | 82.31 | 6.25 | yes |
| L9 Adipate | 89.63 | 6.28 | yes |

TABLE 8-continued

| Ester | % Biodegradation (28 Days) | Standard Deviation | 10-Day Window |
|---|---|---|---|
| MPD/AA/C810 | 86.09 | 3.76 | yes |
| Semi-Linear Ester | | | |
| TMP/isostearate | 63.32 | 1.91 | no |
| TMP/1770 | 76.46 | 1.58 | no |
| TMP/1770 | 83.65 | 6.89 | no |
| Branched Ester | | | |
| TPE/C810/Ck8* | 92.90 | 7.00 | yes |
| TPE/C810/Ck8** | 99.54 | 1.85 | yes |

Notes:
TMP/7810 denotes a tri-ester of trimetholpropane and $C_7$, $C_8$ and $C_{10}$ acids.
TPE/Di-PE/n-$C_7$ denotes esters of technical grade pentaerythritol, di-pentaerythritiol and n-$C_7$ acid.
L9 Adipate denotes a di-ester of adipic acid and n-$C_9$ alcohol.
MPD/AA/C810 denotes a complex ester of 2-methyl-1-,3-propanediol (2 mols), adipic acid (1 mol) and n-$C_8$ and $C_{10}$ acids (2 mol).
Rapeseed Oil is a tri-ester of glycerol and stearic acid.
TMP/isostearate denotes a tri-ester of trimethylolpropane and iso-stearic acid (1 methyl branch per acid chain).
TMP/1770 denotes a tri-ester of trimethylolpropane and a 70:30 mix of n-$C_7$ acid (70%) and alpha-branched $C_7$ acids (30%). The 1770 composition includes approximately 70% n-heptanoic acid, 22% 2-methylhexanoic acid, 6.5% 2-ethylpentanoic acid, 1% 4-methylhexanoic acid, and 0.5% 3.3-dimethylpentanoic acid.
TPE/1770 denotes esters of technical grade pentaerythritol and a 70:30 mix of n-$C_7$ acid (70%) and alpha-branched $C_7$ acids (30%). The 1770 composition includes approximately 70% n-heptanoic acid, 22% 2-methylhexanoic acid, 6.5% 2-ethylpentanoic acid, 1% 4-methylhexanoic acid, and 0.5% 3.3-dimethylpentanoic acid.
*TPE/C810/Ck8 denotes esters of technical grade pentaerythritol and a 45:55 molar ratio of iso-$C_8$ acid (Ck8) and C810 acid.
**TPE/C810/Ck8 denotes esters of technical grade pentaerythritol and a 30:70 molar ratio of iso-$C_8$ acid (Ck8) and C810 acid.

We claim:

1. A biodegradable two-cycle engine oil lubricant which is prepared from:

at least one biodegradable synthetic ester base stock which comprises the reaction product of: a branched or linear alcohol having the general formula $R(OH)_n$, wherein R is an aliphatic or cyclo-aliphatic group having from about 2 to 20 carbon atoms and n is at least 2; and mixed acids comprising about 30 to 80 molar % of a linear acid having a carbon number in the range between about $C_5$ to $C_{12}$, and about 20 to 70 molar % of at least one branched acid having a carbon number in the range between $C_5$ to $C_{10}$ and wherein no more than 10% of said branched acids used to form said biodegradable synthetic ester base stock contains a quaternary carbon; wherein said ester base stock has an oxygen to carbon ratio of between about 0.15:1 to 0.3:1 and exhibits the following properties: at least 60% biodegradation in 28 days as measured by the Modified Sturm test; a pour point of less than −25° C.; a viscosity of less than 7500 cps at −25° C.; and oxidative stability of up to 45 minutes as measured by HPDSC; and a lubricant additive package.

2. The biodegradable lubricant according to claim 1 wherein said ester base stock has an oxygen to carbon ratio of about 0.2:1.

3. The biodegradable lubricant according to claim 1 wherein said mixed acids comprise said linear acid in an amount of about 35 to 55 molar %.

4. The biodegradable lubricant according to claim 3 wherein said mixed acids comprise said branched acid in an amount of about 35 to 55 molar %.

5. The biodegradable lubricant according to claim 1 wherein said branched or linear alcohol is selected from the group consisting of: technical grade pentaerythritol, monopentaerythritol, di-pentaerythritol, neopentylglycol, trimethylolpropane, ethylene or propylene glycol, butane diol, sorbitol, and 2-methylpropane diol.

6. The biodegradable lubricant according to claim 1 wherein said branched acid is predominantly a doubly branched or an alpha branched acid having an average branching per molecule in the range between about 0.3 to 1.9.

7. The biodegradable lubricant according to claim 1 wherein said branched acid is at least one acid selected from the group consisting of: 2-ethylhexanoic acids, isoheptanoic acids, isooctanoic acids, isononanoic acids, and isodecanoic acids.

8. The biodegradable lubricant according to claim 1 wherein said biodegradable lubricant is a blend of said biodegradable synthetic ester base stocks.

9. The biodegradable lubricant according to claim 1 wherein said additive package comprises additives selected from the group consisting of: viscosity index improvers, corrosion inhibitors, oxidation inhibitors, dispersants, lube oil flow improvers, detergents and rust inhibitors, pour point depressants, antifoaming agents, antiwear agents, seal swellants, and friction modifiers.

10. The biodegradable lubricant according to claim 1 wherein said additive package includes at least one additive selected from the group consisting of: viscosity index improvers, corrosion inhibitors, oxidation inhibitors, coupling agents, dispersants, extreme pressure agents, color stabilizers, surfactants, diluents, detergents and rust inhibitors, pour point depressants, antifoaming agents, and antiwear agents.

11. The biodegradable lubricant according to claim 10 wherein said dispersant is a functionalized and derivatized hydrocarbon, wherein functionalization comprises at least one group of the formula —CO—Y—$R^3$ wherein Y is O or S; $R^3$ is aryl, substituted aryl or substituted hyrdocarbyl, and —Y—$R^3$ has a pKa of 12 or less; wherein at least 50 mole % of the functional groups are attached to a tertiary carbon atom; and wherein said functionalized hydrocarbon is derivatized by a nucleophilic reactant.

* * * * *